US006499592B2

(12) United States Patent
Wilfer

(10) Patent No.: US 6,499,592 B2
(45) Date of Patent: Dec. 31, 2002

(54) CASE FOR ACOUSTIC AND/OR ELECTRICAL INSTRUMENTS

(76) Inventor: Hans-Peter Wilfer, Am Hackerhof 5, D-08258 Markneukirchen (DE)

( * ) Notice: Subject to any disclaimer, the term of this patent is extended or adjusted under 35 U.S.C. 154(b) by 0 days.

(21) Appl. No.: 09/745,110

(22) Filed: Dec. 20, 2000

(65) Prior Publication Data

US 2001/0015325 A1 Aug. 23, 2001

(30) Foreign Application Priority Data

Dec. 23, 1999 (EP) ..... 99125744
Jun. 15, 2000 (EP) ..... 00112633

(51) Int. Cl.[7] ..... A45C 11/00

(52) U.S. Cl. ..... 206/314; 206/320; 206/377; 206/14; 190/102

(58) Field of Search ..... 206/14, 314, 320, 206/377, 378; 190/102

(56) References Cited

U.S. PATENT DOCUMENTS 4,190,152 A * 2/1980 Reiter ..... 206/314
4,523,702 A * 6/1985 Viio ..... 206/479
4,531,632 A * 7/1985 Weber ..... 206/14
4,795,030 A * 1/1989 Boyce ..... 190/108
5,219,071 A * 6/1993 Knapp ..... 206/479
5,219,075 A * 6/1993 White ..... 150/162
5,676,223 A * 10/1997 Cunningham ..... 190/109
5,881,850 A * 3/1999 Murdoch ..... 150/113
5,884,768 A * 3/1999 Fox ..... 206/305
5,960,952 A * 10/1999 Chen ..... 190/125
6,029,804 A * 2/2000 Flynn ..... 206/14
6,145,661 A * 11/2000 Jung ..... 190/102
6,283,287 B1 * 9/2001 Carl ..... 190/102

* cited by examiner

*Primary Examiner*—Shian Luong
(74) *Attorney, Agent, or Firm*—Sidley Austin Brown & Wood, LLP

(57) ABSTRACT

A case for acoustic and electrical sound instruments and including bottom and cover sections hingedly connectable with each other, a fastener for releasably securing the cover section to the other bottom section, and a least one retaining band connectable to the bottom section for releasably securing a sound instrument in the case.

21 Claims, 2 Drawing Sheets

CASE FOR ACOUSTIC AND/OR ELECTRICAL INSTRUMENTS

BACKGROUND OF THE INVENTION

1. Field of the Invention

The present invention relates to a case for acoustic and/or electrical sound instruments and, in particular, for string instruments such as guitar or base-guitar, and/or for keyboards, and/or for mixing consoles.

2. Description of the Prior Art

The drawback of conventional cases for musical instruments or other acoustic and/or electrical sound instruments such as, e.g., guitars, base-guitars, keyboards, or mixing consoles consists in that the instrument is reliably held only in a closed condition of the case. Therefore, in case of a defective lock, the instrument can fall out and be seriously damaged.

U.S. Pat. No. 4,531,632 discloses a substantially rectangular case for string instruments such as violins, violas, or guitars with an inner displaceable wall which is displaced to adapt the case to instruments with different body sizes. The displaceable or movable wall has a cut-out section for cradling a neck of a stored string instrument. On opposite sides of the cut-out section, there are provided straps for holding the instrument neck tightly in place. The straps are equipped with a hook and loop fastener. A string instrument, when placed in the case has its neck tightly held with the straps.

German Utility Moder G 89 09 306U1 discloses a formstable case with an inner upholstery for large dimensions, elongate for string instruments, in particular, for string instruments with a body and a neck such as double bass, cello, eletroguitar, or electric double bass. The upholstery surrounds the instrument, preventing its displacement during transportation. The instrument is also held with belts which surround the body in the region of its waist, primarily in the transition region between the body and the neck. The belts are formed as adjustable belts which also can have some elasticity. For retaining of bows, there are provided suspended belts which are equipped with a snap-button fastener or with hook and loop fastener.

British Patent No. 152,482 discloses a case for a violin. For securing the violin in the case, there are provided a first spring clamp surrounding the violin body and engaging the rib, and a second spring clamp for holding the neck.

U.S. Pat. No. 4,190,152 discloses a rigid case for musical instruments, in particular for saxophones, which is equipped with means for preventing shifting of the instrument. The shifting-preventing means includes flexible spring restraints enveloped by rubber tubing. Both ends of the spring restraint are secured to braces which are secured to the case floor with screws, rivets, or glue. Alternatively, the spring restraint ends can be secured directly to the case floor. Instead of a spring restraint enveloped with rubber tubing, a band of an elastic material can be used. The fixation means surrounds the instrument, saxophone, securing it to the floor. There can be provided one or more restraints. However, the attachment of the restraint to braces is relatively expensive and can lead to bending of the braces. Of course, this type of restraints cannot be used with flexible cases.

All of the above-discussed references, U.S. Pat. Nos. 4,531,632; 4,190,152, British Patent No. 152,482, German Utility Model G 89 09 306 U1, disclose a case for musical instruments which is rigid and form stable.

An object of the present invention is to provide a flexible case for acoustic and/or electrical sound instruments with an instrument retaining system suitable for such cases and which would prevent or at least substantially minimize the risk of an instrument being damaged or even destroyed.

SUMMARY OF THE INVENTION

This is and other objects of the present invention, which will become apparent hereinafter, are achieved by providing a case for an acoustic and/or electrical sound instrument, in particular, for a string instrument such as guitar or base-guitar, or for a keyboard, or a mixing console, and having a bottom section and a cover section hingedly connected with each other and which can be closed with an appropriate lock, and at least one retaining band securable to the bottom section for realisably securing the sound instrument to the bottom section, with the retaining band being secured to the bottom section by stitching or with the retaining band passing through a slot or similar opening formed in the bottom section.

In both cases, the retaining band can be easily secured to the bottom section made of a flexible material which permits to make the case of a flexible material in a simple manner. The present invention provides for a stable, tear-resistant attachment of the retaining belt. With such retaining band(s), falling out of the instrument is prevented if the case lock is defective or is damaged.

In accordance with a particularly preferred embodiment of the present invention, at least the bottom section of the case is formed of a flexible material. However, the entire case can also be formed of the flexible material.

As a flexible material, preferably, a textile or similar material can be used for forming the case. A thick plastic film can also be used as a flexible material for forming the case. All of these materials are suitable for use with the retaining band, as they can be easily stitched therewith.

Obviously, the case can be formed as a formstable piece.

In accordance with a further preferred embodiment of the present invention, the case is formed in particular for receiving string instruments having a body and a neck, with the retaining band being designed for securing the neck of the instrument to the bottom section. The neck of a string instrument is particularly suitable for being encompassed with an appropriate retaining band. The neck forms a narrow part of the instrument which insures, with the neck being encompassed, a formlocking attachment. Besides, the surrounded cross-section of the neck of all string instruments is relatively small so that the retaining band can be rapidly and simply connected. The secured retaining band cannot side-slip either to the body or to the head plate. At the head plate, it is the head plate mechanism that prevents the band from side-slipping. The slide-slipping of the band in opposite direction is prevented by the body itself.

With sound instruments having no tapering, curves, etc., but having an almost regular cross-section, such as, e.g., keyboards, the side-slipping of a band-formed restraint can be prevented by appropriately deforming the bottom section.

For a reliable securing of acoustic and/or electrical sound instruments, in particular, of instruments having a rectangular shape such as e.g., as keyboards and mixing consoles, the bottom section and the restraint band so cooperate with each other that with the closed retaining band, the retained musical instrument is prevented from falling out. Thus, the bottom section can be formed as a somewhat tub-shaped element with front, rear, and side walls and which cooperates with the retaining band(s) so that falling the instrument out of the space in the tub-shaped bottom section, which is designed for receiving the instrument, is prevented. Also, the case can be adapted to the outer shape of the sound instrument.

Advantageously, there are provided two or three spaced from each other, retaining bands to more reliably secure the sound instrument and in particular, a keyboard and to prevent it from tilting or falling out from the case.

According to a further embodiment of the present invention, the band engages the bottom section, is secured thereto, between its opposite free ends, with the free ends being releasable connectable by appropriate connections means. In an alternative embodiment, the band(s) can have its (their) end(s) adjacent to the case, connected to the bottom section of the case, with the other end(s) being releasably connected, by an appropriate fastener. As connection means, a hook and Loop fastener, a snap-button fastener, or a buckle can be used. In an alternative embodiment of, the present invention, the band(s) is (are) releasably secured, e.g., to a looped strap or other means which defines a grid or a row of a plurality of attachment points that define different positions of the band(s) which permits to adapt the position of the band(s) to the size of the string instrument.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
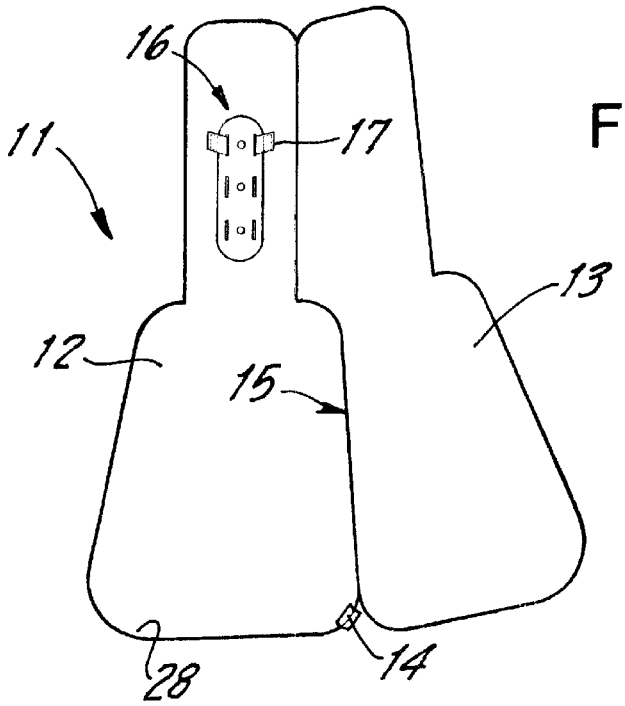
FIG. 1 a schematic view of a case for a guitar according to the present invention in an open condition without the guitar.

FIG. 1 shows a schematic view of a case according to the present invention that can be used not only for a guitar but also for holding different other string instruments such as, e.g., double bass, cello, violin, bass-guitar, et . . . and for holding other acoustic and/or sound instruments, in particular, keyboard, mixing console, etc . . . The guitar case according to the present invention includes a flexible shell 11 which is divided along its narrow side into a bottom section 12 and a cover section 13. The bottom section 12 and the cover section 13 are pivotally connected with each other along a first narrow side 15 of the shell 11. Along the remaining outline of the narrow side of the side 15, the bottom section 12 and the cover section 13 are connected by a locking device 14 which is formed, preferably, as a zip fastener.

For releasably securing a guitar or other instrument in the case, a retaining element 16 is arranged on the bottom section 12 of the shell 11. The retaining element 16, which is used, primarily, for securing the neck 34 of a guitar, includes a band 17 which can be stitched directly to the bottom section 12 or indirectly secured thereto.

Figure 2:
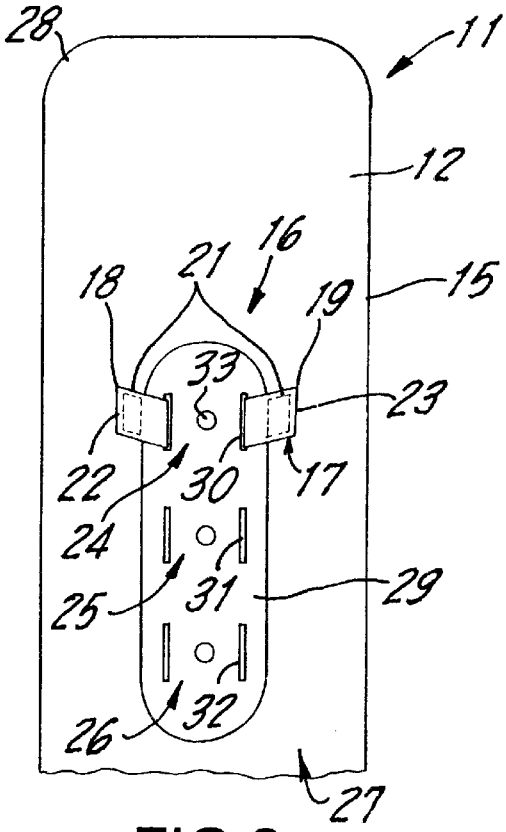
FIG. 2 a schematic view of a holding device arranged on a bottom section of the case shown in FIG. 1.

The retaining element 16 is schematically shown in FIG. 2. The band 17 of the retaining element 16 has first and second free ends 18 and 19. The band 17 engages the shell 11 at the bottom section 12 between the free ends 18 and 19. In the embodiment shown in the drawing, the band 17 is secured to the bottom section 12 only indirectly via a looped strap 29. The strap 29 has a grid 27 of different attachment points 24, 25, 26 for accommodating different guitar sizes. The strap 19 can be formed as a rectangular leather trimming stitched to the bottom section 12. The leather trimming has a plurality of punch-out sections which correspond to the attachment points 24, 25, 26 and which define loops 30, 31, 32 for passing the band 17. To provide for fixation of the band 17 parallel to the longitudinal extent of the case, a snap fastener 33 is provided between each of the loops 30, 31, 32. The snap fastener 33 insures release of the band 17 from an associated loop 30, 31, 32 and securing it in another of the loops 30, 31, 32.

At its free ends 18, 19, the band 17 is provided with a hook and loop fastener 21 such as e.g., a Velcro® fastener 21. A first element 22 of the Velcro® fastener 21 is secured on the upper surface of the first free end 18, and a second element 23 of the Velcro® fastener 21 is secured on the lower surface of the second free end 19.

Figure 3:
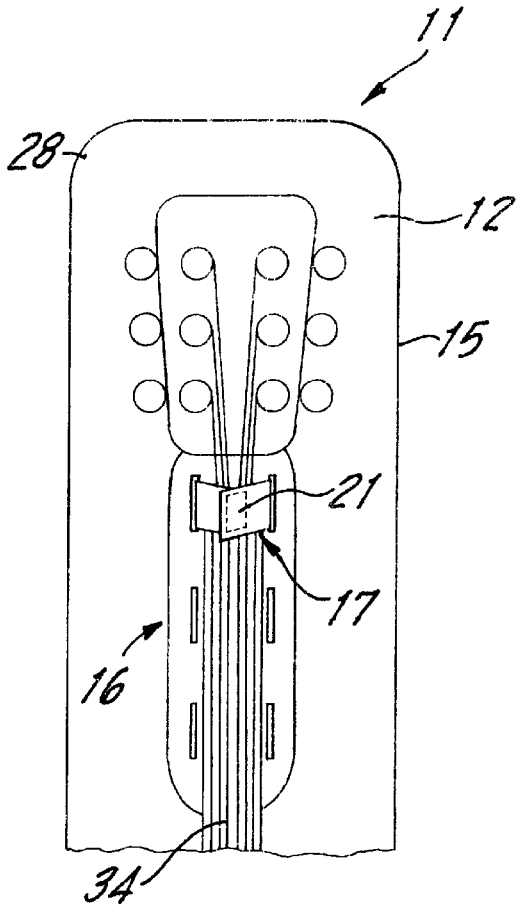
FIG. 3 a schematic view illustrating securing a guitar to the bottom which secures the neck of the guitar.

In order to secure the guitar neck 34 in the bottom section 12 of the shell 11 the guitar is placed in the shell 11, as shown in FIG. 3, and the band 17 encompasses the neck with its free ends 18, 19 being connected by the Velcro® fastener 21. The Velcro® fastener 21 provides for quick securing and release of the neck 34 of the guitar. The damage to a guitar in case of a defective zip fastener is prevented. In addition, the band 17 insures that the guitar is stabilized during the transportation of the case.

Figure 4:
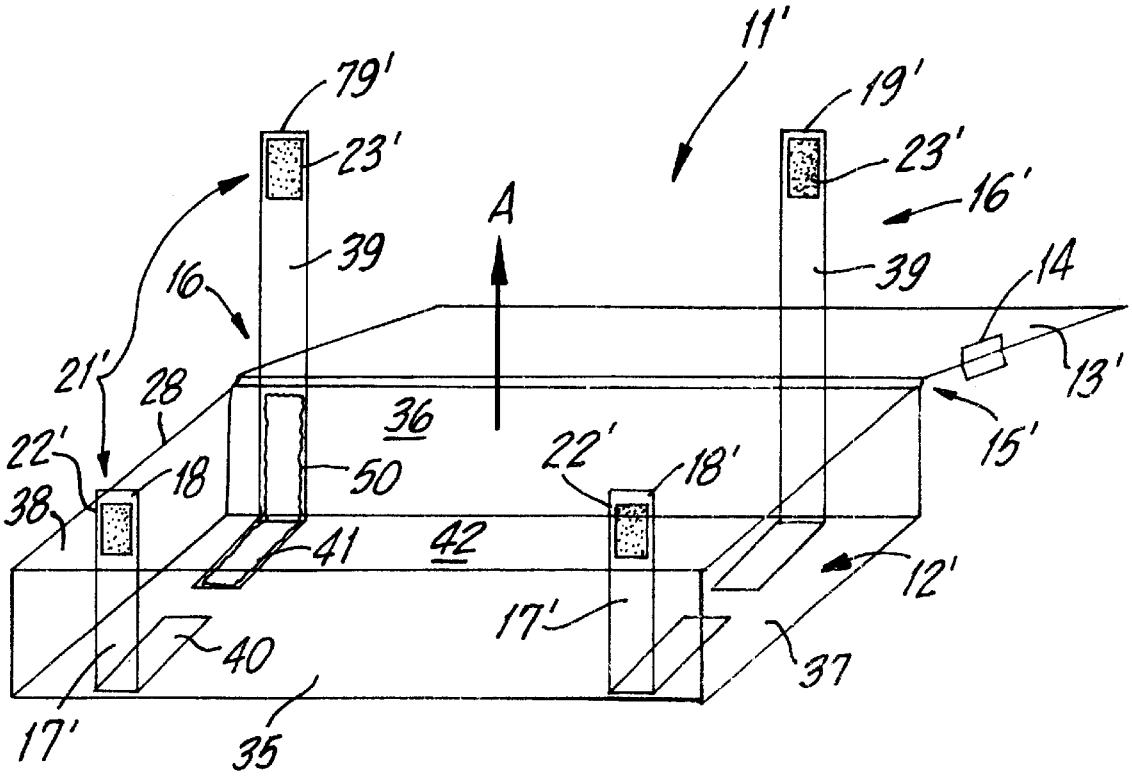
FIG. 4 a schematic view of a case for a keyboard according to the present invention in an open condition without a keyboard.

Another embodiment of the inventive case is shown in FIG. 4. The case shown in FIG. 4 is designed for storing and transporting substantially rectangular acoustic and/or sound instruments such as, e.g., keyboard or zither. The case can be formed with a flexible shell $\mathbf{11}^1$ having a bottom section $\mathbf{12}^1$ and a cover section $\mathbf{13}^1$. The bottom section $\mathbf{12}^1$ has a bottom 42, a front wall 35, a rear wall 36, and two walls 36, 37. The bottom section $\mathbf{12}^1$ has an approximately tub-shaped structure. The bottom section $\mathbf{12}^1$ and the cover section $\mathbf{13}^1$ are pivotally connected along a first side $\mathbf{15}^1$. Along the remaining outline $\mathbf{28}^1$, the tub-shaped bottom section $\mathbf{12}^1$ and the cover section $\mathbf{13}^1$ are connected by a locking device $\mathbf{14}^1$ which is formed preferably as a zip fastener.

In the embodiment shown in FIG. 4, two restraining elements $\mathbf{16}^1$ are secured to the bottom section $\mathbf{12}^1$ for realizably securing a sound instrument (keyboard, zither, etc . . .) stored in the case. Each of the restraining elements $\mathbf{16}^1$ includes two bands $\mathbf{17}^1$ 39 the ends 40, 41 of which adjacent to the bottom section $\mathbf{12}^1$ are secured thereto, preferably, to the bottom section $\mathbf{12}^1$. The bands $\mathbf{17}^1$, 39 can also be secured to the front and rear walls 35, 36, respectively, by a stitched seam 50. Alternatively, the bands $\mathbf{17}^1$, 39 can be secured only to the front and rear walls 35, 36, respectively, also by the stitched seam 50. In FIG. 4, only one stitched seam 50 for securing the second band 39 to the rear wall 36 is shown.

The free ends $\mathbf{18}^{1,}$ $\mathbf{19}^1$ of the bands $\mathbf{17}^1$, 39 are provided with appropriate fastener $\mathbf{21}^1$, namely, with respective elements $\mathbf{22}^1$, $\mathbf{23}^1$ of the hook and loop fastener $\mathbf{21}^1$. The band $\mathbf{17}^1$, which is associated with the front wall 35, is provided, on the side of its free end 18 facing outwardly, with a first hook and loop element $\mathbf{22}^1$ which cooperates with a corresponding second hook and loop element $\mathbf{23}^1$ provided on the side of the free end $\mathbf{19}^1$ of the band 39 facing inwardly.

The restraining elements $\mathbf{16}^1$ insure rapid securing and release of a stored sound instrument, which is located in the bottom section $\mathbf{12}^1$ of the shell $\mathbf{11}^1$. The restraining elements $\mathbf{16}^1$ also provide for the stabilization of the instrument. With the case shown in FIG. 4, care should be taken to conform the dimensions of the case to the dimensions of the sound instrument to even more secure the instrument from falling out.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A case for acoustic and electrical sound instruments, comprising:

a bottom section;

a cover section;

means for hingedly connecting the cover section with the bottom section;

locking means for releasably securing the cover section to the bottom section;

at least one retaining band connectable to the bottom section for releasably securing a sound instrument; and means for connecting the retaining band with the bottom section and comprising opening means formed in the bottom section for passing the at least one retaining band therethrough.

2. A case as set forth in claim 1 wherein the case has a shape corresponding to an outer contour of a sound instrument.

3. A case as set forth in claim 1, wherein the releasably securing means comprises a zip fastener.

4. A case as set forth in claim 1, wherein the hingedly connecting means comprises a stitching.

5. A case as set forth in claim 1, wherein the case is formed of a flexible material.

6. A case as set forth in claim 1, wherein the case is formed as a rigid body.

7. A case as set forth in claim 1, wherein the bottom section is tub-shaped and has a front wall, a rear wall, and side walls, and wherein the at least one retaining band prevents a sound instrument from falling out from the case in a direction determined by a tub-shape of the case.

8. A case as set forth in claim 1, further comprising another retaining band spaced from the at least one retaining band, whereby sound instrument is secured at two points spaced from each other.

9. A case as set forth in claim 1, wherein the at least one retaining band is secured to the bottom section in a region between free ends of the retaining band, and wherein the case further comprises attachment means for connecting the free ends of the at least one retaining band with each other.

10. A hook as set forth in claim 9, wherein the attachment means comprises a hook and loop fastener.

11. A case as set forth in claim 1, wherein the at least one retaining band is formed of two band sections having each one end thereof secured to the bottom section, and wherein the case further comprises attachment means for releasably connecting another ends of the two band sections with each other.

12. A case as set forth in claim 11, wherein the attachment means comprises a hook and loop fastener.

13. A case as set forth in claim 12, wherein the hook and loop fastener comprises a first hook and loop element provided on an upper side of the another end of one of the band sections and a second hook and loop element provided on a lower side of the another end of another of the band sections.

14. A case as set forth in claim 12, wherein the hook and loop fastener comprises a first hook and loop element provided on an upper side of one of the free-ends and a second hook and loop element provided on a lower side of another of the free ends.

15. A case as set forth in claim 1, wherein the at least one retaining band is formed of a flexible but substantially non-elastically deformable material.

16. A case as set forth in claim 15, wherein the at least one retaining band is formed of one of a textile material and a textile-like material.

17. A case as set forth in claim 1, wherein at least the bottom section is formed of one of textile material and a textile-like material.

18. A case for acoustic and electrical sound instruments, comprising:

a bottom section;

a cover section;

means for hingedly connecting the cover section with the bottom section;

locking means for releasably securing the cover section to the bottom section;

at least one retaining band connectable to the bottom section for releasably securing a sound instrument; and stitched seam means for connecting the retaining band with the bottom section wherein the at least one retaining band is secured to the bottom section in a region between free ends of the retaining band, and wherein the case further comprises attachment means for connecting the free ends of the least one retaining band with each other.

19. A case as set forth in claim 18, wherein the attachment means comprises a hook and loop fastener.

20. A case as set forth in claim 19, wherein the hook and loop fastener comprises a first hook and loop element provided on an upper side of the free-ends and a second hook and loop element provided on a lower side of another of the free ends.

21. A case for string instruments having a body and a neck, the case comprising;

a bottom section;

a cover section;

means for hingedly connecting the cover section with the bottom section;

locking means for releasably securing the cover section to the bottom section;

at least one retaining band connectable to the bottom section for releasably securing the neck of a string instrument means for connecting the retaining band with the bottom section and comprising opening means formed in the bottom section for passing the at least one retaining band therethough.

* * * * *